US006341455B1

(12) United States Patent
Gunn

(10) Patent No.: US 6,341,455 B1
(45) Date of Patent: Jan. 29, 2002

(54) PROTECTIVE COVER ASSEMBLY

(76) Inventor: Cameron T. Gunn, 15197 Montrose Rd., Miami, FL (US) 33016

( * ) Notice: Subject to any disclaimer, the term of this patent is extended or adjusted under 35 U.S.C. 154(b) by 0 days.

(21) Appl. No.: 09/657,366

(22) Filed: Sep. 7, 2000

(51) Int. Cl.[7] ..... E06B 3/26

(52) U.S. Cl. ..... 52/202; 52/506.05; 52/506.06; 52/DIG. 12; 160/290.1

(58) Field of Search ..... 52/202, DIG. 12, 52/506.05, 506.06, 506.01; 160/290.1, 302

(56) References Cited

U.S. PATENT DOCUMENTS

| | | | | | |
|---|---|---|---|---|---|
| 1,417,104 | A | * | 5/1922 | Pachesa | 160/27 |
| 4,685,261 | A | | 8/1987 | Seaquist | |
| 5,097,883 | A | | 3/1992 | Robinson | |
| 5,228,238 | A | | 7/1993 | Fenkell | |
| 5,457,921 | A | | 10/1995 | Kostrzecha | |
| 5,469,905 | A | | 11/1995 | McKinney | |
| 5,477,903 | A | | 12/1995 | Figueiredo | |
| 5,505,244 | A | * | 4/1996 | Thumann | 160/23.1 |
| 5,595,233 | A | | 1/1997 | Gower | |
| 5,601,130 | A | | 2/1997 | Werner | |
| 5,603,190 | A | * | 2/1997 | Sanford | 52/202 |
| 5,620,037 | A | | 4/1997 | Apostolo | |
| 5,787,642 | A | | 8/1998 | Coyle | |
| 5,852,903 | A | | 12/1998 | Astrizky | |
| 5,918,430 | A | | 7/1999 | Rowland | |
| 5,941,031 | A | | 8/1999 | Fullwood | |
| 5,957,185 | A | | 9/1999 | Robinson | |
| 5,957,186 | A | | 9/1999 | Boswell | |
| 5,996,292 | A | | 12/1999 | Hill | |
| 6,089,300 | A | | 7/2000 | Woodside | |

* cited by examiner

*Primary Examiner*—Carl D. Friedman
*Assistant Examiner*—N. Slack

(57) ABSTRACT

A protective cover assembly used to cover and protect windows, doors or other wall openings for homes, office buildings, hotels, and other walled structures from the destructive forces of a high windstorm, such as a hurricane. The current form of the preferred embodiment consists of a high strength fabric covering an opening, such as a window and being supported by brackets, a rod and a bar. Once installed, the high strength fabric is stretched over the opening, through the use of a gears and ratchet assembly. The high strength fabric once stretched will provide protection from high winds and wind borne debris common in storms such as hurricanes. The protective cover assembly also prevents unlawful entries or break-ins of buildings. The high strength fabric is securely supported to the rod and steel bar that are firmly attached to the wall structure near the wall opening.

10 Claims, 9 Drawing Sheets

PROTECTIVE COVER ASSEMBLY

CROSS-REFERENCE TO RELATED APPLICATIONS

"Not Applicable"

STATEMENT REGARDING FEDERALLY SPONSORED RESEARCH OR DEVELOPMENT

"Not Applicable"

Reference to a "Microfiche Appendix"

"Not Applicable"

BACKGROUND OF THE INVENTION (1) Field of the Invention

The present invention relates to storm protection equipment such as hurricane shutters or storm shutters, which protects glass windows, doors or other openings from violent storms or from burglary.

(2) Description of the Related Art

Hurricanes or other violent storms have created tremendous damage to homes, businesses, buildings, etc due to high winds over the last several years. The violent storms have caused the loss of life, in addition have cost the United States billions of dollars in disaster aid. The insurance companies have had to pay claims in the billions of dollars due to the violent storms, which in the case of Hurricane Andrew in 1992 bankrupted several insurance companies. The United States formed the Federal Emergency Management Agency (FEMA) to provide disaster aid after a major event such as a hurricane. FEMA is mandated to encourage and fund hazard mitigation, by preventing or minimizing damage prior to the event. One of the simplest mitigation option is to install hurricane shutters on the windows and doors to prevent building damage. The hurricane shutters provide protection to the windows or openings from the high winds, rains and also from flying debris. The flying or wind borne debris can act as a missile piercing the structures. Most debris will not pierce the structural wall of a building, but if the debris hits a window, the building's structural integrity is compromised. In the extreme winds of a hurricane, a broken window can allow damaging wind and rain to enter the building and put extreme design strains on the roof. The roof is not designed to accept forces from within the building, such as the case when a window is broken during a hurricane situation. In some cases, this breach in the structure can cause the roof to detach from the house or have severe damage that would not have otherwise occurred.

Home Owners and business owners are looking for cost-effective methods and easy to use devices to protect their home, families and businesses during a hurricane. One of the methods is a hurricane shutter or some type of covering for the window to prevent high winds and rain from entering the building. One of most cost-effective method is the use of plywood, which is firmly attached to the building by nails or screws. This will provide some protection, however the plywood is very difficult and very time consuming to install. There are safety concerns with plywood since the plywood is often left on the windows through the entire hurricane season. If a fire occurs within the building, it is difficult to escape out the window if the plywood is still attached. Other methods to protect the windows or doors in a building are the use of hurricane or storm shutters. There are basically four kinds of hurricane shutters available on the market today; Storm Panel, Accordion Shutters, Colonial/Bahama Shutters, and Roll-Up Shutters. There are several advantages and disadvantages for each system.

Storm Panels are either galvanized or aluminum steel corrugated steel panels that are installed over the window. The advantage of this system is that they are relatively inexpensive. The disadvantage of this system is they are not easily installed due to heavy weight and size and are time consuming to install. They are often left on during the hurricane season causing a hazard for the occupants of the building in the case of fire or any other incident, similar to the plywood panels.

Accordion Shutters are generally made of galvanized steel that form an accordion shape when opening and closing. The advantage of this system is the ease of operation and they are generally permanently attached for which requires no installation prior to a storm. The disadvantage of the system is that it often does not match the exterior design of the building and the cost is significantly more than the storm panels.

The colonial/Bahama shutters are made of wood, metal or a synthetic material that is permanently attached to building and are incorporated into the exterior window of the building. They are essentially solid shutters that are closed over the windows during a storm. The advantage of the system is the ease of operation, cost effectiveness, in some cases, and they are permanently attached. The disadvantage of this system is that the panels do not fit many exterior designs of buildings from an aesthetics view. The bahama shutters also limit the amount of light that can enter a window as well as distract from the view, which is not acceptable to many homeowners.

The final type of hurricane shutter is the roll-up, which has several metal panels connected that can be rolled up into a cover. The shutter is permanent and can be motorized for ease of use. The advantage of this system is the ease of operation and that it is permanently installed. The disadvantage is the high cost of the shutter and they require periodic maintenance to ensure operation.

An example of an accordion shutter is in U.S. Pat. No. 5,957,185 by Robinson & Tillit, Sep. 28, 1999 with their deployable and stackable accordion shutter system. The merits of this invention are that it can be deployed quickly and easily and not take up much space within the window space. As stated above, the cost of this type of shutter is expensive. The present invention has similar objects or goals as the U.S. Pat. No. 5,957,185, however is approached differently using flexible high strength materials such as high strength fabrics and different types of hardware instead of using metal panels and guides. The common goal is to provide a costeffective and easy to use window or wall opening barrier that will meet the strict code requirements. Although U.S. Pat. No. 5,957,185 has its merits, the cost of the shutter is much more expensive than the present invention and has limitations on uses, as stated above.

There are no specific prior art that is similar to the present invention in the specific design and purpose. There are prior art that provide the same objective of the present invention, however they are not similar in design. Whatever the precise merits, features and advantages of the above cited references and types of shutters, none of them achieve or fulfill the purposes of the present invention.

The present invention has been developed to meet the requirements of ease of operation, ease of installation and cost-effectiveness. The expected cost for the present invention is to be less thean storm panels, but cost more than plywood. The present invention can be permanently installed or temporarily installed depending on the architecture of the building and building owner's preference. The current shutters available on the market are either classified as ease of operation or cost-effective. The present invention provides ease of use and cost effectiveness. With the present invention, the cost of the invention will be within the reach of many homeowners or building owners. In addition, the ease of use will promote the use of wind and rain protection during all types of storms, whether category 5 Hurricanes or severe thunderstorms. This will equate to less damage and less insurance claims or disaster aid. More importantly, this will lead to less devastation for affected families and business owners.

BRIEF SUMMARY OF THE INVENTION

This invention relates to an original design for an exterior covering of wall openings for use in protecting all wall openings in buildings from severe wind and rain damage or from wind bonie objects during storms, such as hurricanes and from burglary. The design involves using a flexible high strength material such as high strength fabric that is expanded over the covering providing the necessary protection from hurricane force winds and wind borne debris, as well as providing a protective barrier from burglary.

A high strength flexible material, such as a high strength fabric, is secured to a rigid circular element such as a steel rod at one end and secured to a rigid element such as a steel bar at the other end. The steel rod and steel bar are connected to wall by some means such as brackets, on either side of the wall opening to secure the steel rod and the steel bar to the wall. When the high strength fabric, with the steel rod are placed in the brackets on one end, the high strength fabric is pulled over the wall opening to the other bracket and the steel bar portion is inserted into the bracket. Using the rotational transmission system such as a gear system, and engaging a means to maintain the rigid circular element's position such as ratchet system or a pawl, and a wrench is used to tighten the high strength fabric by rotating the steel rod which is secured to the high strength fabric. Once the high strength fabric is significantly tight, the ratchet system will maintain the position of the rod thus ensuring tightness. The tight high strength flexible material or fabric creates a strong barrier against flying debris and against the fierce wind that occurs during a storm. The high strength fabric used for the device is much less expensive than current aluminum panels based on per square foot costs, therefore even with the additional hardware it would provide the most cost effective, manufactured "Hurricane Shutter" available. There are several high strength fabrics in the market today, which will be applicable, such as Geomembranes that are used in oil tank dike areas, as liners for protection of the environment from potential spills. The Geomembrane materials must be high strength since they must endure large trucks driving on the materials, and must be tear resistant to avoid any breach in the lining and potential enviromnental problem. There are also automobile airbag materials that must endure high impact without tearing. There are several high strength fabrics on the market that are inexpensive and provide the necessary strength required for the present invention.

In addition, the protective cover assembly has the strength to deter burglars from entering the building when installed with a locking mechanism. The protective cover assembly can be locked and it will deter unlawful entry into a building.

DETAILED DESCRIPTON OF THE INVENTION

Figure 1:
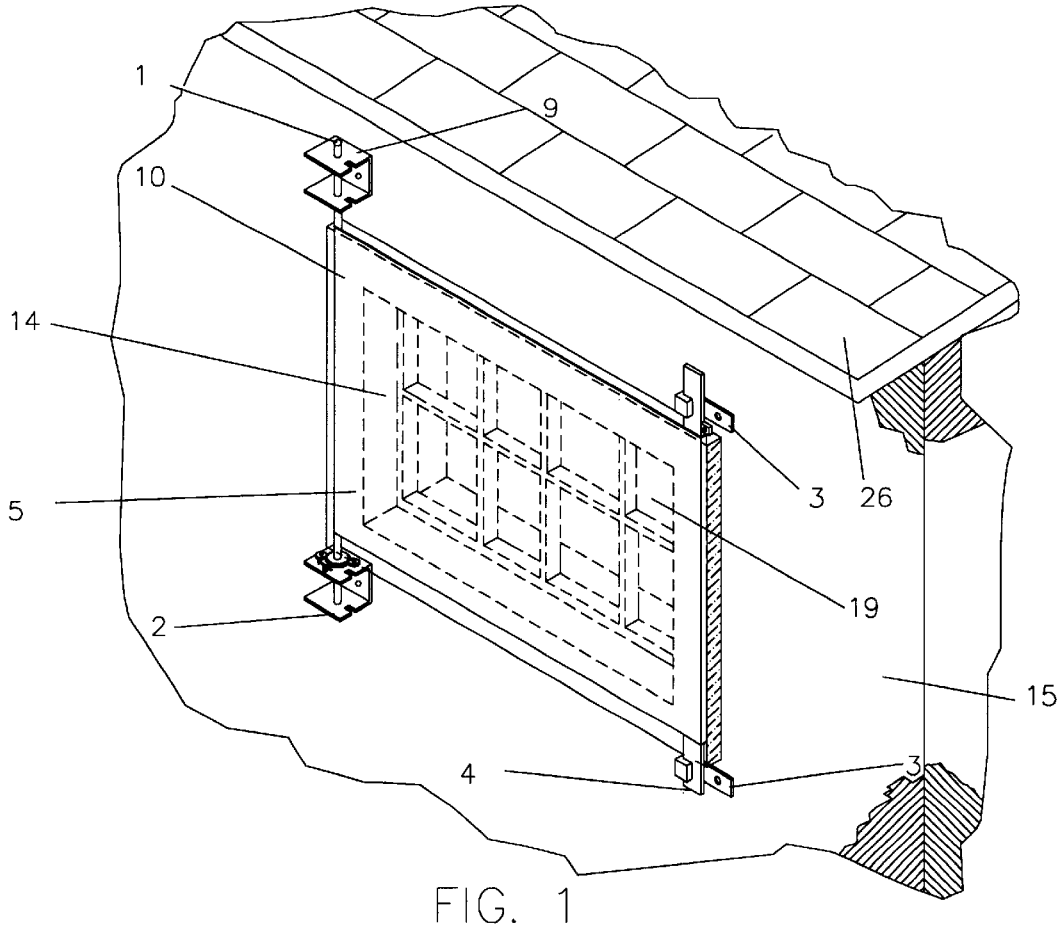
FIG. 1, is a three dimensional view of the installed preferred embodiment of the protective cover, over a window on a residential house in the protective mode or in the closed position.

A protective cover assembly for wall openings which embodies the concepts and principles of the preferred embodiment of the invention is illustrated in FIG. 1, which is shown generally as reference numeral 10, representing a single protective cover over a window at a house. The protective cover can be various sizes to cover various wall openings such as sliding glass doors, doors, or windows, and is shown on one type of window in the drawing for illustration purposes and one form of the present invention. The protective covering assembly of the preferred embodiment of the invention includes a high strength fabric 5, a rod 1, rod bottom bracket 2, rod top bracket 9, bar 4, main gear 6, secondary gear 18, spring 21, turning nut 22, rod/bar threaded rod 27, anchor bolts 16, anchor bolts nuts 24, spring retainer 23, ratchet assembly 7, rod/bar nuts 17, extender bar connection 12, and secondary gear 18. The protective covering assembly 10 is typically placed on the exterior of a building with the steel rod top bracket 9, steel rod bottom bracket 2, and the steel bar bracket 3 attached on the exterior of the building. The materials to be used for the protective cover assembly are only limited by their strength, weather resistance, weight, and costs. The rod 1, bar 4, rod bracket bottom 2, rod bracket top 9, main gear 6, secondary gear 18, rod/bar nuts 17, rod/bar threaded rod 27, spring 21, turning nut 22, spring retainer 23 can be plastic, composite or metal. The preferred materials for the invention, of the above-mentioned items, are corrosion resistant metals or steel due to its strength and rigidity. The high strength fabric 5 can be polyolefm fabrics, polypropylene geomembranes, hypalon, edpm, hdpe, permalon or any other type of high strength fabric that has sufficient strength to withstand the forces created during a high wind storm.

The preferred material of construction for the high strength fabric 5 is polyolefin fabric due to the high impact resistance, ultraviolet protection and low cost.

In FIG. 1, the protective cover assembly 10, is shown in the closed position with the bar 4 inserted in the bar brackets 3 and the h igh strength fabric 5 stretched across the opening for protection of window during high windstorms. The windowsill 14 and window 19 is outlined and shown in the background to illustrate the position of the protective cover assembly 10 over the wall opening. The wall 15 with the roof 26 is shown at the comer of the building to illustrate the protective cover assembly in relation to the building.

Figure 2:
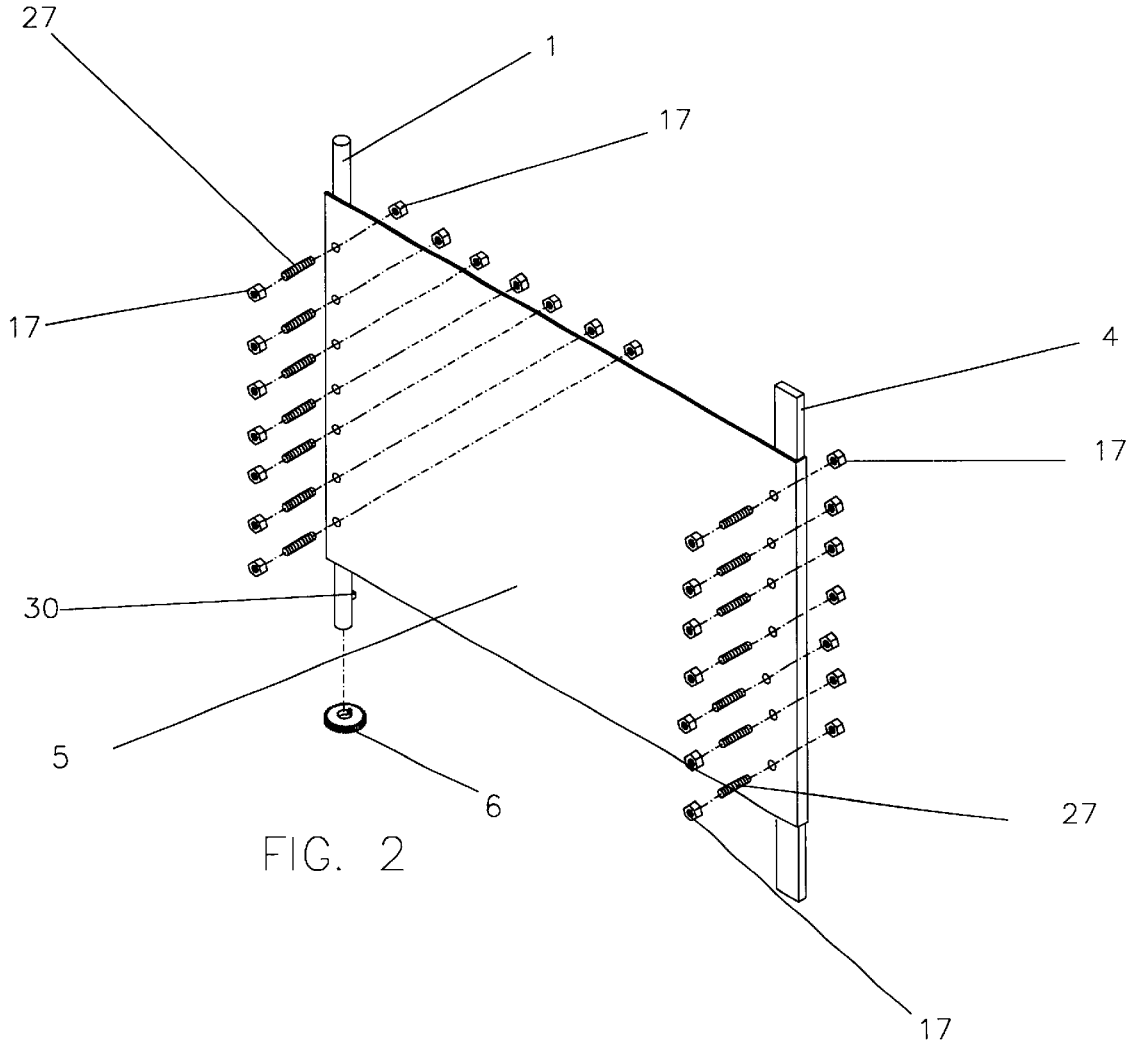
FIG. 2, is a three dimensional view of the preferred embodiment of the protective cover without the brackets to illustrate the rod and bar attachments to the high strength fabric. Also indicating how the main gear is placed over the rod.

In FIG. 2, the protective cover assembly 10, is extended to show connections of the high strength fabric 5 to the rod 1, and bar 4 using rod/bar nuts 17 and rod/bar threaded rod 27 in the preferred embodiment of the invention without brackets. The initial step in fabrication of the protective cover assembly 10 is to drill holes into the rod 1, bar 4 and the high strength fabric 5 at appropriate intervals. During the drilling of the holes, the high strength fabric 5 is folded over the bar 4 and placed over the rod 1 as shown to ensure the holes line up on the rod 1 and bar 4 with the high strength fabric 5. Once the holes have been drilled the rod/bar-threaded rod 27 is inserted into the holes on the rod 1 and bar 4. Once the rod/bar-threaded rod 27 is inserted, the rod/bar nuts 17 are screwed onto each end of the rod/bar threaded rod 27 and secure the high strength fabric 5 to the rod 1 and bar 4. The main gear 6 is inserted onto the rod 1, by sliding ithe main gear 6 over rod 1 and placing within the keyed area. The main gear 6 will be keyed or have a slot inserted into the borehole of the gear, that is commonly manufactured with gears. The keyway 30 on rod 1, will be dimensioned to slot that is main gear 6, thus securing the main gear 6 to rod 1.

Figure 3:
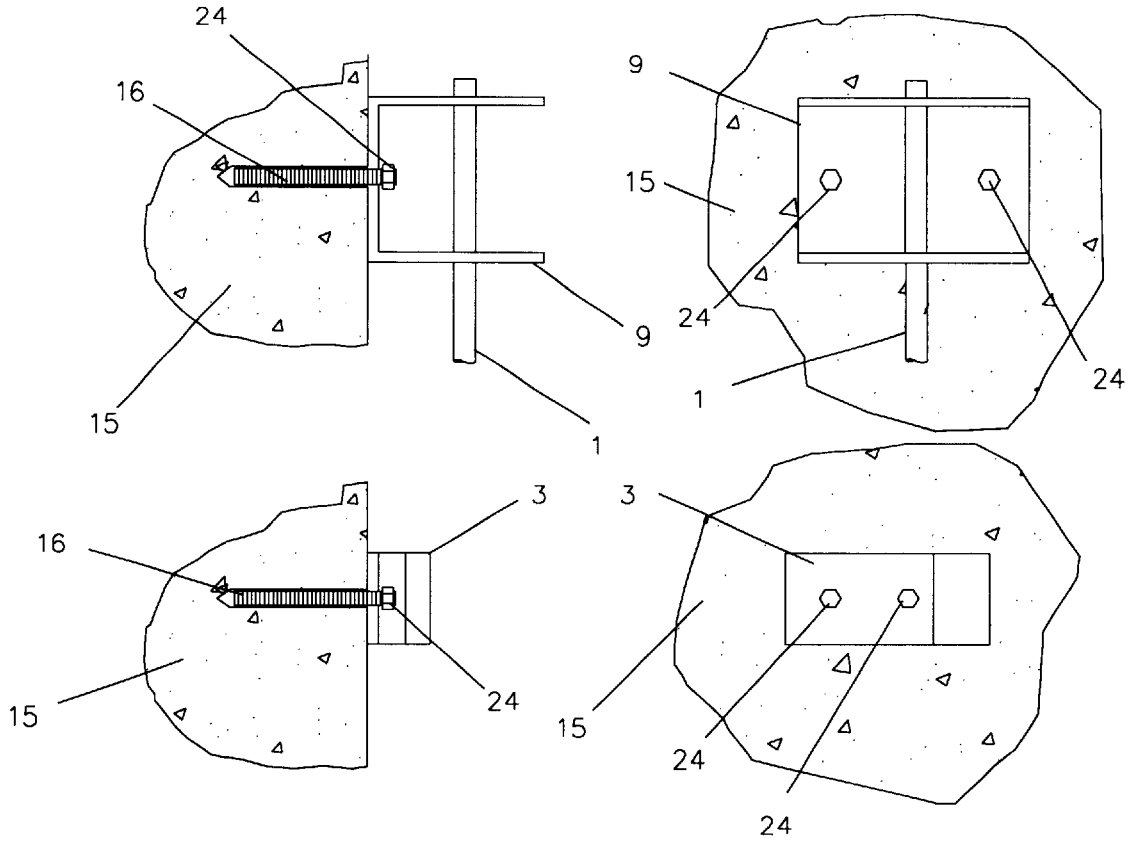
FIG. 3, is a 2-D view of each type of bracket illustrating the anchor bolts that are embedded inlo the concrete block.

In FIG. 3, the anchor bolt connections for the rod brackets top 9, and bar bracket 3 are shown. In the preferred embodiment of the invention, the wall 15 is comprised of concrete block. The wall could be wood, however for illustration purposes, the wall 15 is concrete block and anchor bolts 16 are expansion anchors for concrete wall. The process involves lining up the rod bracket top 9 in the location on the wall 15 where it is be located. The rod bracket top 9 holes are marked on the wall 15. Then, using a drill the holes are drilled into the wall 15. The anchor bolts 16 are inserted into the drill hole. The rod bracket top 9 is placed against the wall 15 over the anchor bolts 16 and anchor bolt nuts 24 are placed over the anchor bolts 16 and tightened. The rod bracket top 9 is now secured to the wall 15. The same procedure applies for the illustrated bar bracket 3.

Figure 4:
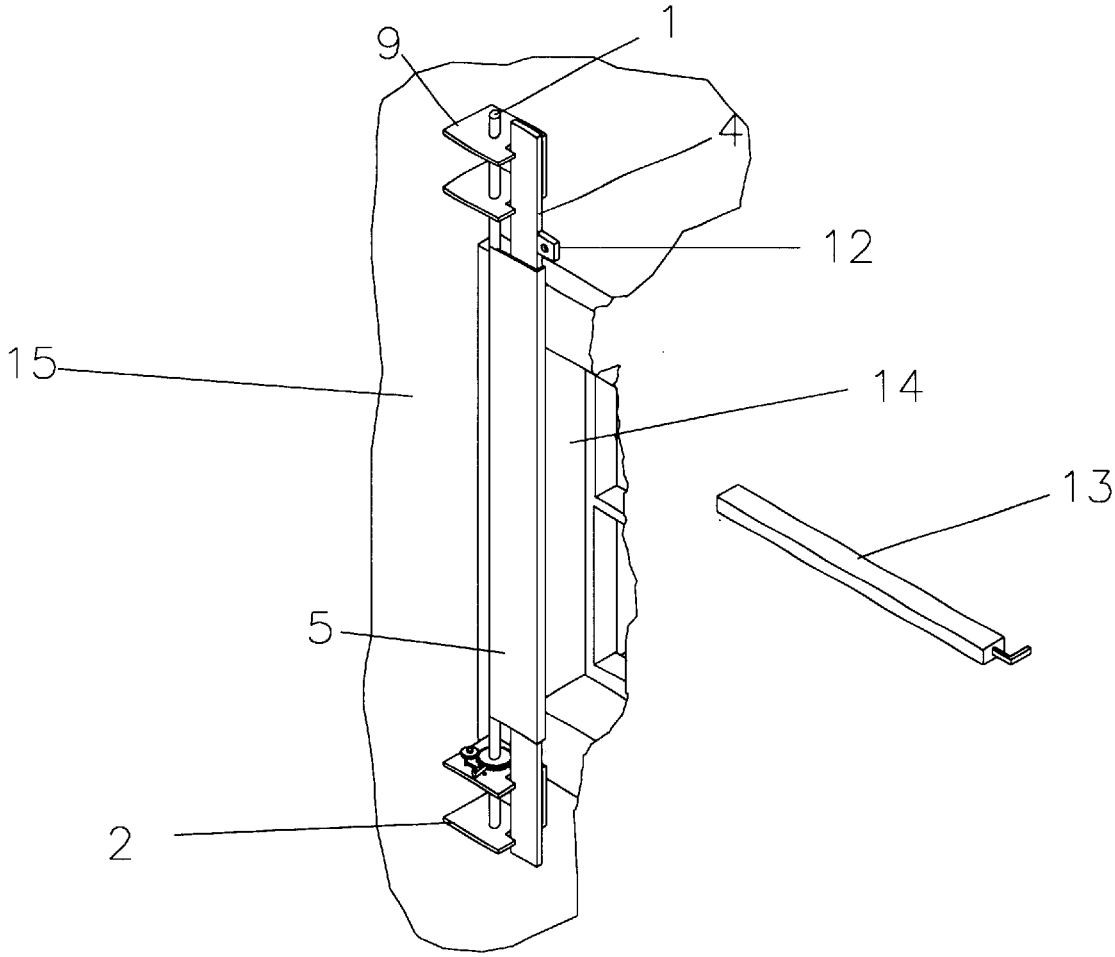
FIG. 4, is a three dimensional sectional view of the preferred embodiment attached to the wall in the open position or unprotected mode with brackets and extender bar shown.

In FIG. 4, the complete rod 1, rod bracket bottom 2, and rod bracket top 9 assembly is shown as the first step in installation onto the wall 15 as a cut away. In this preferred embodiment of the invention, the rod bracket top 9 and rod bracket bottom 2 will be installed onto the wall 15 at the time of installation as indicated above. The rod bracket bottom 2 will be installed first onto the wall 15 using the anchor bolt 16 connections as shown in FIG. 3, by placing nuts 24 over anchor bolts 16 and tightening as described above. The next step is to install the rod 1, with high strength fabric 5 and main gear 6, as shown in FIG. 2, is inserted in the rod bracket bottom 2 by inserting into the hole on the rod bracket bottom 2 and insuring that the main gear 6 meshes with secondary gear 18. For further details, refer to FIG. 6. The rod bracket top 9 is then placed over the top of rod 1. The rod bracket top 9 is attached to the wall 15 using anchor bolts 16, as shown in FIG. 2, by placing anchor bolt nuts 24 over the anchors bolts 16 and tightening. The protective cover assembly 10 is installed on one side of the window. The extender bar 13 and extender bar connection 12 is shown in FIG. 4. The purpose of the extender bar 13 is to allow complete the operation of the protective cover at high elevations such as a second story on a house. The protective cover assembly 10 could be installed at high elevations and to minimize the movement of a ladder, the extender bar 13 would be utilized. A ladder would be placed on one side of the window 19 and the extender bar 13 would be inserted into the extender bar connection 12 and pushed or pulled to move the protective cover assembly 10 to the bar brackets 3. The extender bar 13 would be of sufficient length to reach the other side of window 19. This would allow the operator to not move the ladder to the other side of the window 19 opening to insert the bar 4 into bar brackets 3.

Figure 5:
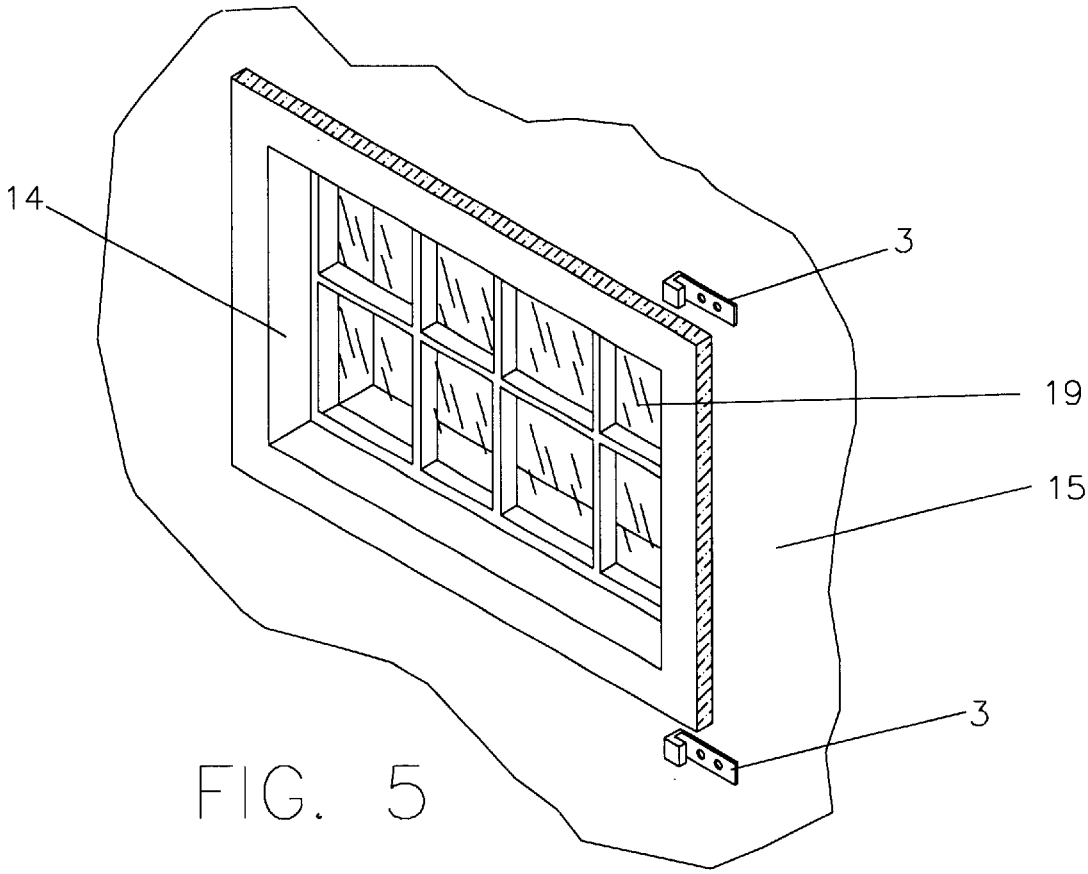
FIG. 5, is a three dimensional view of the preferred embodiment with only the bar brackets on the wall in relation to the window without the remaining protective cover assembly to illustrate location and to illustrate how the initial brackets are installed.

In FIG. 5, the bar brackets 3 are illustrated without the complete protective cover assembly 10 installed which is the first step in installing the protective cover assembly 10. The brackets 3 will be installed similar to rod brackets top 9 and rod brackets bottom 2. The anchor bolts 16 are installed as per FIG. 3, and the anchor bolts 24 nuts are installed over the bar brackets 3. The installation will provide a strong connection to the wall 15. The window sill 14 and window 19 are shown to illustrate the position of the bar bracket 3 in relation to window 19 and to illustrate the first step in installing the protective cover assembly 10.

Figure 6:
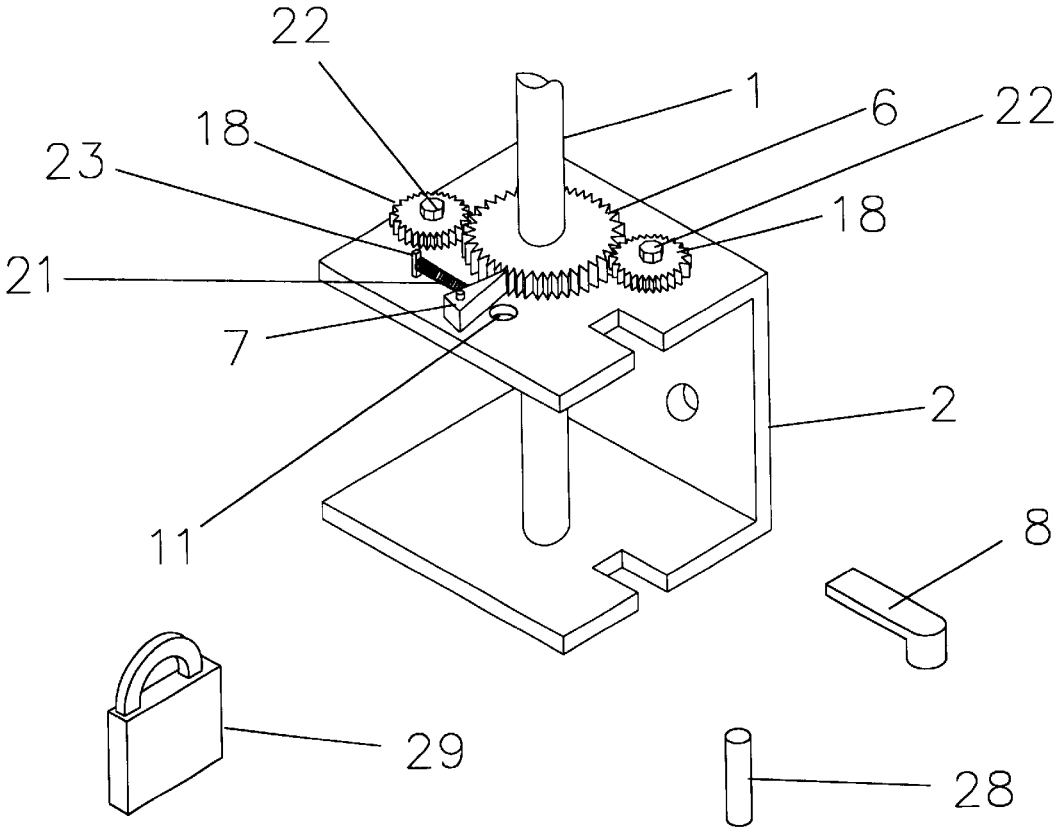
FIG. 6, is a partial and exploded view of the detail of the installed preferred embodiment of bottom rod bracket with gear, and ratchet assembly to illustrate the operations of the gear and ratchet system.

In FIG. 6, the rod bracket bottom 2 is shown, in detail, in expanded 3-D view with main gear 6, secondary gear 18, ratchet assembly 7, wrench 8, spring 21, spring retainer 23, and turning nut 22. The purpose of the gear assembly is to be able to stretch the high strength fabric 5 using the main gear 6 and secondary gear 18 with the turning nut 22 with a ratchet assembly 7, spring 21 and spring retainer 23 to maintain the stretched high strength fabric 5 at a certain tension after installation. The stretched high strength fabric 5 creates the strong barrier between wind borne debris and the window 19 to prevent damage to window 19. The stretched high strength fabric 5 also creates a strong barrier to prevent burglars from entering the building through the window 19. The secondary gear 18 has a turning nut 22 attached to the top that allows the secondary gear 18 to be rotated, using wrench 8. Using wrench 8, the secondary gear 18 is rotated, thus rotating main gear 6. The main gear 6 is connected to rod 1 thus rotating rod 1 when the secondary gear 18 is rotated. The rotation of the secondary gear 18 stretches the high strength fabric 5. During the final assembly of the protective cover assembly 10, the high strength fabric 5 is stretched when ratchet assembly 7 is engaged. When the racket assembly 7 is engaged it operates similar to a winch where the racket assembly 7 is inner meshed with the main gear 6 and maintained against the main gear 6 with a spring 21 which is connected to spring retainer 23 and ratchet assembly 7. The spring 16 keeps the ratchet assembly 7 against the main gear and not allow the rod to rotate in the opposite direction that the high strength fabric 5 is being stretched. The ratchet assembly 7 is angled sufficiently to not allow the main gear 6 to rotate in the opposite direction.

The ratchet assembly 7 with the spring 16 and the spring retainer 23, will not allow the high strength fabric 5 to become loose or rod I to rotate. The ratchet assembly 7 will retain the high strength fabric 5 tight across the window opening to protect the window 19 from wind borne debris. When initially installing the protective cover assembly 10, the ratchet assembly 7 is disengaged, by pushing the racket assembly 7 back over the lock pin hole 11 and insert the lock pin 28 to allow the free rotation of the rod 1 to pull across the wall opening to connect the bar 4 to bar bracket 3. The lock hole 11 also serves as hole for a lock 29, which can be inserted into the hole after the protective cover assembly 10 as been installed and placed in the closed position. The installed lock 29 would prevent the racket from being released and allowing the protective cover assembly 10 from opening. This could be used to lock the device to prevent burglary. See FIG. 3 for details on the anchor bolt 16 connection to the bar brackets 3.

Figure 7A:
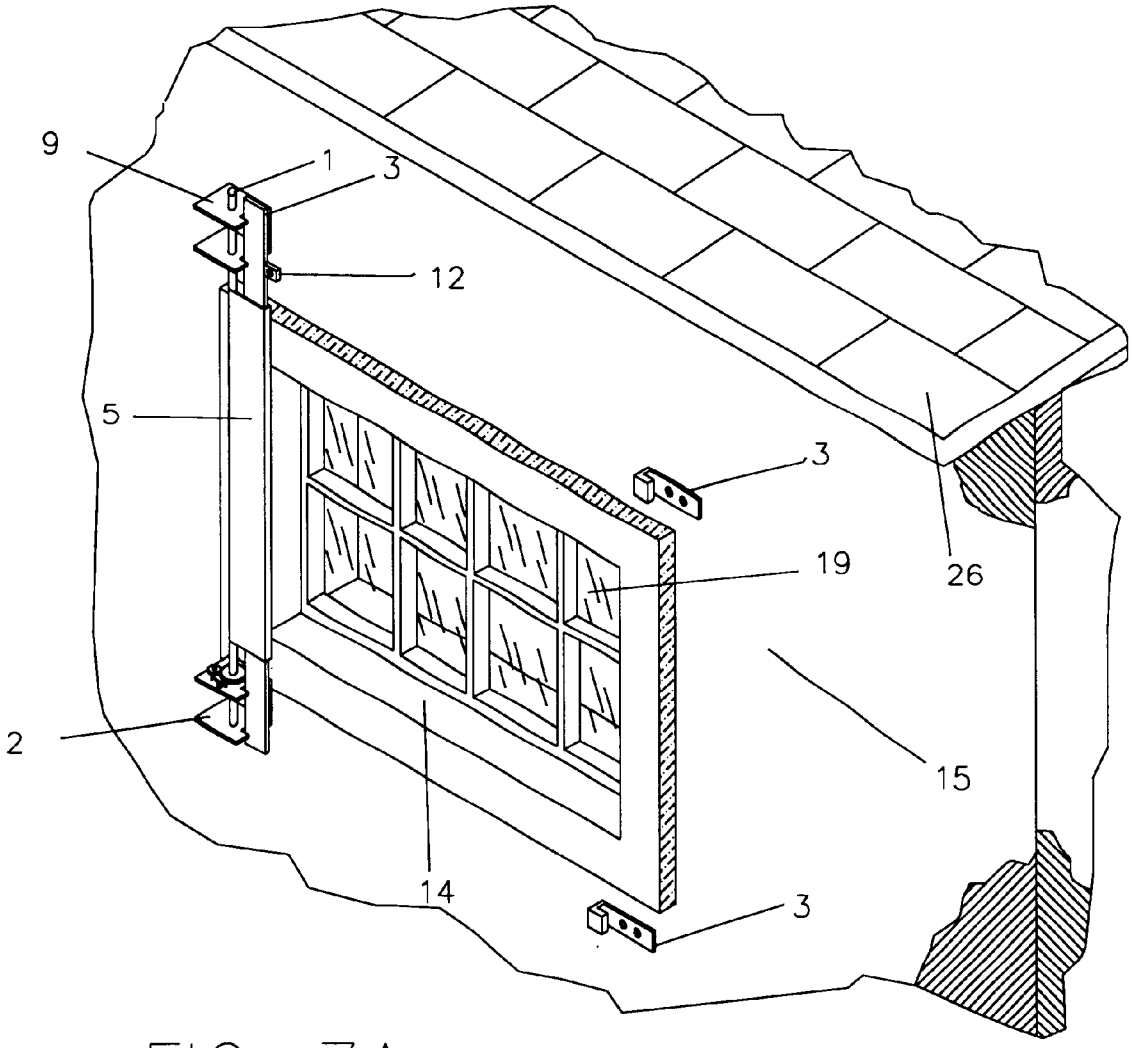
FIG. 7*a*, is a plan view of the preferred embodiment of the protective cover assembly that is in the open position to illustrate the operations of the protective cover assembly and to illustrate the amount of space required for the assembly.

In FIG. 7A, the open position of the protective cover assembly 10 is shown to illustrate the operations of the protective cover assembly 10. When the protective cover assembly 10 is initially installed or is not in use, FIG. 7A illustrates the current position of the protective cover assembly 10 as it is in relation to the wall 15, the roof 26 and the window 19.

Figure 7B:
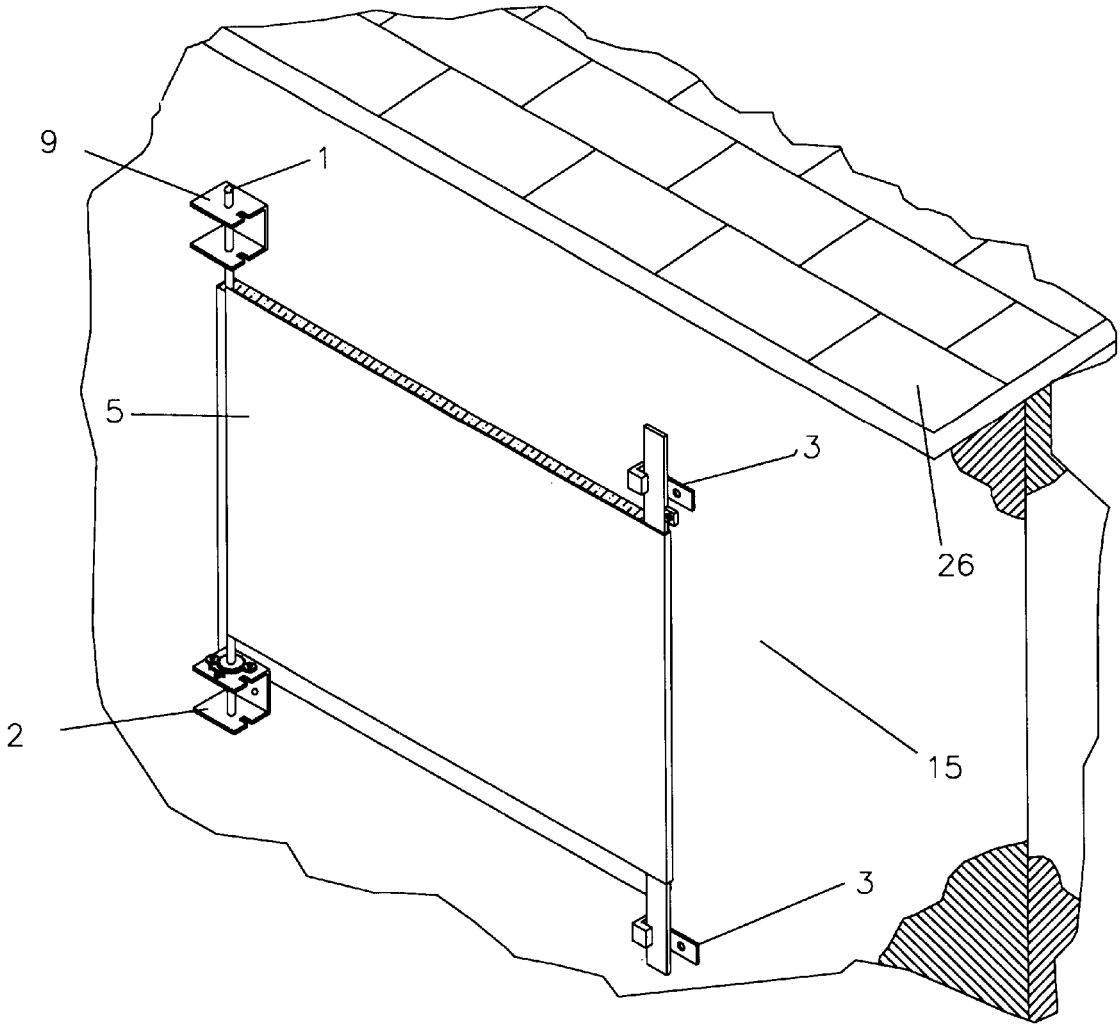
FIG. 7*b*, is a plan view of the preferred embodiment of the protective cover assembly that is in the closed position to illustrate the operations of the protective cover assembly.

In FIG. 7B, the close position of the protective cover assembly 10 is shown to illustrate the operations of the protective cover assembly 10. The high strength fabric 5 is pushed over the wall opening to protect the window 19, this can be accomplished by using the operator's hand to drag the high strength fabric 5 over the wall opening or using an extended bar 13 by inserting tie extended bar 13 into the extended bar connection 12, as described above. The extended bar 13 could be used when installing on windows located well above the ground where ladders are required to install the protective cover assembly 10. Once the protective cover assembly 10 is in the position shown in FIG. 7*b*, the high strength fabric 5 can be stretched using the assembly as shown in FIG. 6. The stretched high strength fabric 5, will now provide a strong barrier against wind borne debris.

Figure 8:
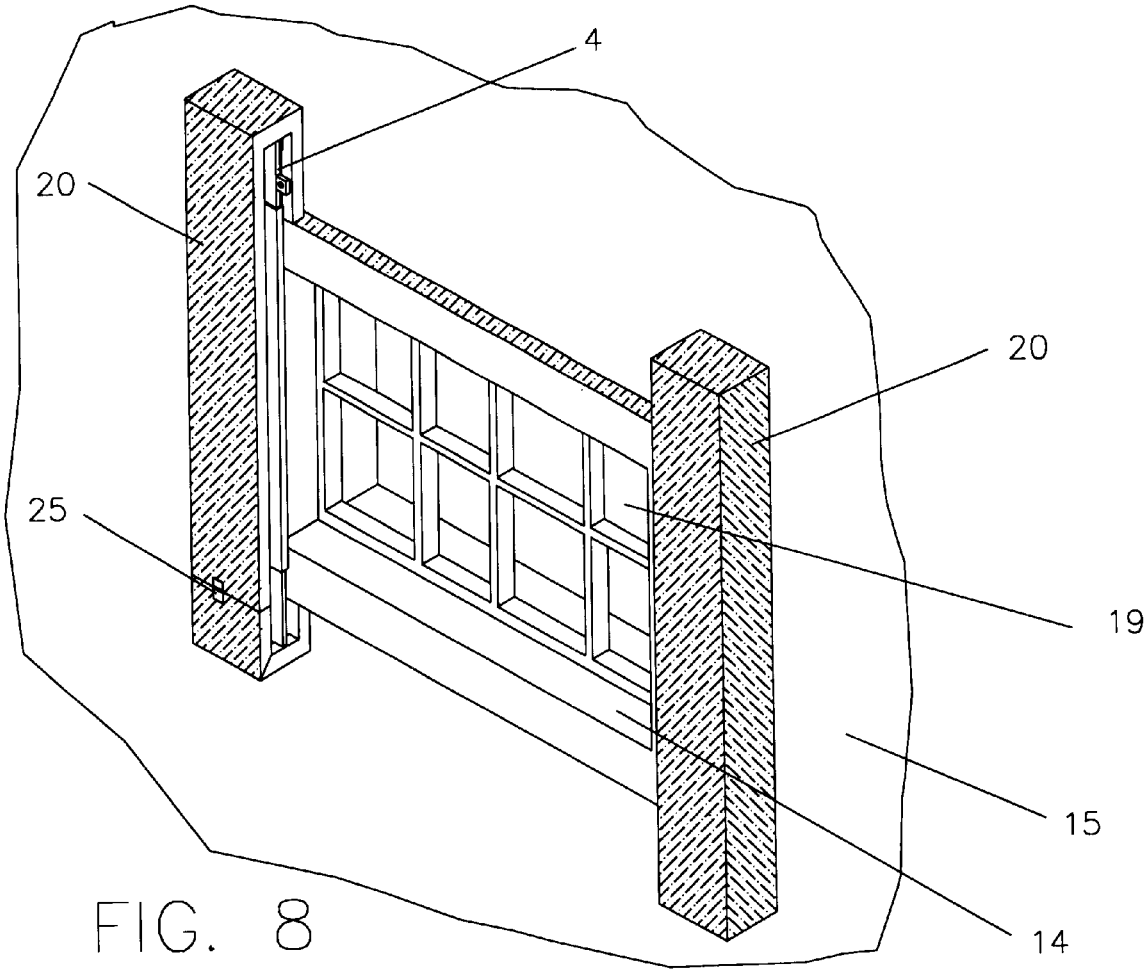
FIG. 8, is a three dimensional view of the protective covering assembly in the open position with optional covers for permanent installation.

In FIG. 8, the protective cover assembly 10, is illustrated in the open position with an optional cover 21 shown in an open position for illustration purposes. The optional cover 21, will allow the protective cover assembly 10 to be permanently installed and the optional cover 21 colors can match the exterior of the building. Therefore the protective cover assembly 10, will only be closed prior to a storm or at during times when the building is not being occupied for an extensive amount of time. There is a security lock options available, which would allow for protection from burglars as described above. The covers 21 will enclose the protective cover assembly from the view of the exterior of the building. The covers 21 can be designed and colors chosen to enhance the view of the building.

The reader can see that the protective cover assembly 10 of the preferred embodiment of the invention provides a easy to use and install protective cover for wall openings that is of high strength to protect against high wind and wind borne debris yet economical.

The foregoing description of the preferred embodiment of the invention has been illustrated and described for the purposes of presentation. It is not intended to be exhaustive or to limit the invention to the preferred embodiment disclosed. Many modifications and variations are possible. It is intended that the scope of the invention be limited not by this detailed description, but rather by the claims appended hereto.

I claim:

1. A protective cover assembly, for protection of a wall opening during extreme weather conditions, comprising;

A high strength flexibe material of sufficient size to cover the wall opening,

A rigid circular element long enough to marginally exceed the dimensions of a wall opening, A rigid element long enough to marginally exceed the dimensions of the wall opening, Means of connecting said high strength flexible material to said rigid circular element, Means of connecting said high strength flexible material to said rigid element, Means of support and to connect the said rigid circular element to the wall, while allowing for rotation of said rigid circular element on one side of wall opening, A means of support and to connect the said rigid element to the wall on the opposite side of the wall opening of said rigid circular element, A rotary transmission means to rotate said rigid circular element to stretch said high strength flexible material as the said rigid circular element is connected to said high strength flexible materal and said rigid element is also connected to high strength flexible material which the said rigid element and said rigid circular element are connected to the wall , A means to maintain the rigid circular element position after being rotated to specific position so that said high strength material remains stretched, Whereby, the protective cover assembly covers the wall opening completely and protects against wind, rain, wind borne debris, and other elements associated with storms.

2. A protective cover assembly as set forth in claim 1, wherein the high strength flexible material is high strength fabric.

3. A protective cover assembly as set forth in claim 1, wherein the rigid circular element is a steel rod.

4. A protective cover assembly as set forth in claim 1, wherein the rigid element is a steel bar.

5. A protective cover assembly as set forth in claim 1, wherein the means to support the said rigid circular element to the wall, while allowing for rotation of the said rigid circular element on one side of the wall opening is a steel bracket with holes that allow the insertion and holding of the said rigid circular element and holes for the said rotary transmission means, and holes for means to maintain the rigid circular element position.

6. A protective cover assembly as set forth in claim 1, wherein the said means to connect said high strength material to the said rigid element is accomplished by inserting a bolt and nut through the said high strength flexible material and the said rigid circular element and through the said rigid element.

7. A protective cover assembly as set forth in claim 1, with an additional decorative cover would be placed over the protective cover assembly in the closed position and the said means of supporting the rigid element, thus allowing the protective cover assembly to be installed permanently and the elements of claim 1 would not be exposed from the exterior of the building.

8. A protective cover assembly as set forth in claim 1, with an extender connection comprising of a steel metal piece with a small hole which is attached to the said rigid element, with an extender bar that would insert into the extender connection, that would allow the protective cover assembly to move over the opening at high elevations that require a ladder, but would not need to move the ladder to the other side of the wall opening.

9. A protective cover assembly as set forth in claim 1, wherein the said rotary tansmission means is a main gear on the said circular rigid element and a secondary gear connected to the said bracket that supports and connects the said rigid element to the wall, with the secondary gear having a turning nut on top and intermeshed with the main gear.

10. A protective cover assembly as set forth in claim 1, wherein the means to maintain the rigid circular element position after being rotated to specific position is completed by using a ratchet assembly and a spring with a spring retainer to apply pressure to the main gear similar to a winch which does not allow reverse rotation of the said rigid circular element, however when the ratchet assembly is disengaged and moved away from the main gear by placing a lock pin in the lock hole to keep the ratchet assmebly away from the said rotary transmission means, wherein during ratchet engagement, the lock hole can have an ordinary lock placed into the hole, not allowing the reverse rotation of the said rigid circular element, thus not allowing the protective cover assembly to be opened.

* * * * *